US009100765B2

(12) United States Patent
Sim et al.

(10) Patent No.: US 9,100,765 B2
(45) Date of Patent: Aug. 4, 2015

(54) AUDIO ENHANCEMENT MODULE FOR PORTABLE MEDIA PLAYER

(75) Inventors: Wong Hoo Sim, Singapore (SG); Steven Erickson, Campbell, CA (US)

(73) Assignee: Creative Technology Ltd, Singapore (SG)

( * ) Notice: Subject to any disclaimer, the term of this patent is extended or adjusted under 35 U.S.C. 154(b) by 1463 days.

(21) Appl. No.: 11/770,598

(22) Filed: Jun. 28, 2007

(65) Prior Publication Data

US 2008/0008324 A1 Jan. 10, 2008

Related U.S. Application Data

(60) Provisional application No. 60/806,454, filed on Jun. 30, 2006.

(51) Int. Cl.
*H04R 5/00* (2006.01)
*H04S 5/00* (2006.01)

(52) U.S. Cl.
CPC ..... *H04S 5/00* (2013.01)

(58) Field of Classification Search
CPC ..... H04S 5/00; H04S 3/00; H04S 2420/01
USPC ..... 381/334, 1, 300, 310, 17; 700/94
See application file for complete search history.

(56) References Cited

U.S. PATENT DOCUMENTS

| | | | | |
|---|---|---|---|---|
| 7,970,144 | B1 * | 6/2011 | Avendano et al. | 381/1 |
| 2004/0049379 | A1 * | 3/2004 | Thumpudi et al. | 704/205 |
| 2006/0018486 | A1 * | 1/2006 | Neoran et al. | 381/63 |
| 2007/0055395 | A1 * | 3/2007 | Debettencourt et al. | 700/94 |

FOREIGN PATENT DOCUMENTS

| | | | |
|---|---|---|---|
| JP | 2006-094367 | | 4/2006 |
| JP | 2006094367 | A * | 4/2006 |

* cited by examiner

*Primary Examiner* — Paul S Kim
(74) *Attorney, Agent, or Firm* — Russell Swerdon; Desmund Gean

(57) ABSTRACT

An audio or video enhancement module incorporates advanced audio enhancement effects. These advanced effects cover a wide range including but not limited to 3D audio spatialization (virtualization) and transient enhancement. The device is configured for receiving an audio input signal, in analog or digital form, enhancing the received signal, and transmitting an output audio signal having the enhanced effects embedded in the signal. The output signal may be either digital or audio. Further, the output signal may be a mono signal, a stereo signal, a MIDI signal, or a multichannel signal (such as 2.1, 5.1, 7.1, etc.). User input to the module is provided to control the amount of audio enhancement.

11 Claims, 7 Drawing Sheets

AUDIO ENHANCEMENT MODULE FOR PORTABLE MEDIA PLAYER

CROSS-REFERENCES TO RELATED APPLICATIONS

This application claims priority from provisional U.S. Patent Application Ser. No. 60/806,454, filed Jun. 30, 2006, titled "Audio Enhancement Module for Portable Media Player" the disclosure of which is incorporated by reference in its entirety. This application is related to and incorporates by reference for all purposes U.S. patent application Ser. No. 11/744,465, filed May 4, 2007, titled "METHOD FOR ENHANCING AUDIO SIGNALS" which claims priority from provisional U.S. Patent Application Ser. No. 60/746,625, filed May 5, 2006.

BACKGROUND OF THE INVENTION

1. Field of the Invention

The present invention relates to audio products. More particularly, the present invention relates to methods for enhancing audio transmitted from a portable media player.

2. Description of the Related Art

With the advancements in audio technology, increased memory storage, and increased computer processing power, attention has been placed on providing advanced audio effects on computers through software and in some cases add-in boards such as PCI boards.

Concurrently, the field of portable audio has also expanded dramatically. Current portable devices are capable of storing and rendering thousands of music and other audio tracks over headphones or other sound reproduction transducers connected to the portable players. Many of these devices are small enough to be carried in a user's pocket. Unfortunately, many of the advanced audio effects presently available and expected to be available in the future require processing demands so large that they cannot be easily integrated within the portable devices without adversely affecting the portability nature of the devices. Further constraints are imposed on the portable device from power requirements and the need to load or manage content in the device. Currently, content is conventionally loaded into the device by tethering the device to a host PC, for example by a USB cable. Typically, a content management program is run on the PC in order to download the content.

In order to conserve storage space in the portable device and to minimize the bandwidth requirements for transmission of the content, audio content loaded from the host PC is compressed, for example according to an mp3 or wma codec. These codecs provide good fidelity when decoded but nonetheless provide music that is lacking in some attributes. Unfortunately, portable media players provide very little options for the user to modify the perceptual attributes of the sound rendered by the portable device. These typically include nothing more than equalization and fail to suitable address the customized listening needs of the user or the environment.

Portable media devices often place heavy demands on power from batteries integrated into the device. These batteries are often rechargeable but need at least intermittent connection to a power supply for recharging.

The typical user's experience thus involves listening to "flat" music through headphones, periods where the device's batteries are connected to a power supply for recharging, and periods of connecting the portable device to a host PC for managing the device's content. Unfortunately, each of these steps often is incompatible with other ones of the steps, hence requiring multiple cables and familiarity with various software programs.

It is therefore desirable to provide a device and methods capable of improving the user experience for the user of a portable media player.

SUMMARY OF THE INVENTION

The present invention provides a module that incorporates advanced audio enhancement effects. These advanced effects cover a wide range including but not limited to 3D audio spatialization (virtualization) and transient enhancement. The device is configured for receiving an audio input signal, in analog or digital form, enhancing the received signal, preferably through a user control on the portable device, and transmitting an output audio signal having the enhanced effects embedded in the signal. The output signal may be either digital or audio. Further, the output signal may be a mono signal, a stereo signal, a MIDI signal, or a multichannel signal (such as 2.1, 5.1, 7.1, etc.)

In accordance with one embodiment, an external audio enhancement module is provided. The module is configured to receive an audio input signal from a portable media player, such as for a non-limiting example, a Zen Vision M portable media player manufactured and distributed by Creative Technologies LTD. The module is further configured to process the received audio signal using advanced audio processing techniques and to transmit the processed signal to an audio reproduction system. Preferably, the module is further configured to receive the device in a docking connector and to provide synchronization (content management), battery power management (recharging and external supply) and transmission of rendered content to a plurality of devices through a wired or wireless connection.

In accordance with yet another embodiment, a method for enhancing an audio signal is provided. An audio signal is received. The audio signal is converted to a digital representation if necessary and digitally filtered to enhance the perceptual characteristics of the audio signal. The enhancements include upmixing the signal to a multichannel representation and virtualizing the multichannel representation for rendering over a two-channel playback system. In another embodiment the characteristics of the audio signal are dynamically enhanced, in response to the energy level of the signal or transient detection. In yet another embodiment, the processing includes any combination of upmixing, virtualization, and dynamic enhancement. In a preferred embodiment, the method includes enabling the user to control the amount of audio enhancement interactively through the use of a user control integrated with the portable audio enhancement module.

These and other features and advantages of the present invention are described below with reference to the drawings.

DETAILED DESCRIPTION OF PREFERRED EMBODIMENTS

Figure 1:
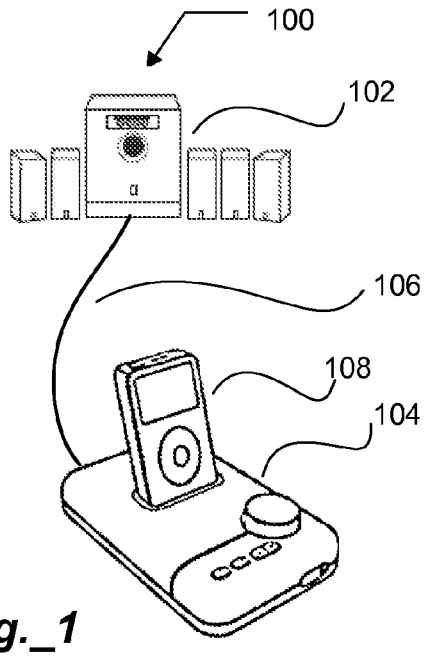
FIG. 1 is a diagram illustrating an audio enhancement module used in a system in accordance with one embodiment of the present invention.

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

In accordance with one embodiment, a module that incorporates advanced audio enhancement effects is provided. These advanced effects cover a wide range including but not limited to 3D audio spatialization (virtualization) and transient enhancement. The device is configured for receiving an audio input signal, in analog or digital form, enhancing the received signal, and transmitting an output audio signal having the enhanced effects embedded in the signal. The output signal may be either digital or audio. Further, the output signal may be a mono signal, a stereo signal, a MIDI signal, or a multichannel signal (such as 2.1, 5.1, 7.1, etc.)

Advanced audio enhancements are now provided for use with Personal Computers, such as in conjunction with plug in audio sound cards. The present invention, in various embodiments, makes these audio enhancements available to portable media devices such as mp3 players in an audio enhancement module. These enhancements include but are not limited to 3D audio spatialization or virtualization effects and transient enhancement techniques, as will be explained in further detail below.

Preferably a module is provided for integration or connection to other electronic products in order to enable a system to include audio enhancement algorithms. In some embodiments, the audio enhancements include but are not limited to dramatic improvements to the recording and playback of MP3 music, enhancement to the listening experiences for movies, and improvements in general to the capabilities, performance and quality of audio and music creation. Preferably, the module is configured to enable the user to select from several surround audio enhancement effects and to control the amount of the effect to suit the users' preferences. Many of these audio enhancements are commercially available in computer sound cards provided by Creative Technologies Ltd. For example, the X-Fi soundcard provided by Creative Technologies Ltd. presently allows a user options including MultiSpeaker Surround 3D Surround, MultiSpeaker Surround 3D Headphone, MultiSpeaker Surround 3D Virtual, X-Fi Crystallizer, Dolby Digital decoder, DTS-Interactive 5.1 Encoder.

In one embodiment, a module is provided that permits selection of the above mentioned types of audio enhancements through GPIO pin (level detect) or I2C bus, and Digital input/output. The audio enhancements preferably include but are not limited to the enhancement effects which are described in further detail below.

X-Fi CMSS®-3D enables a user to Upgrade MP3 music and movies into surround sound with headphones or multichannel speakers. This is important because it enables a consumer to enjoy stereo MP3s and movies in surround sound created with X-Fi CMSS®-3D technology. While the present invention is intended to include the basic upmixing of stereo content, the audio enhancement module is preferably configured to remix the audio intelligently to match the speaker system (including headphones). The audio enhancement techniques that may be configured into the module include advanced techniques to extract specific audio elements so your music and movies sound more alive than ever, i.e., to add in one embodiment "punchiness". The potential benefits when listening to or creating music are abundant. For example, static stereo music may be converted into surround sound suitable for playback over multichannel Speakers. Although in one embodiment, the enhanced listening experience is provided when listening to music tracks, the invention includes other forms of media content. For example, videos or movies may be enhanced to provide surround sound over headphones or speakers. Thus, an example surround sound processing technique suitable for integration into the module to enjoy movies is the X-Fi CMSS®-3D.

Other processing techniques provided in other embodiments enable up mixing, virtualization over output channels, transient enhancement, and decoding. These are generally described with the following examples:

1. X-Fi CMSS®-3D Surround: Provides a multichannel playback for stereo music or movies.
2. X-Fi CMSS®-3D Headphone: Provides a multichannel playback experience over headphones for all types of content
3. X-Fi CMSS®-3D Virtual: Provides a multichannel playback experience over two loudspeakers for all types of content
4. X-Fi Crystallizer™—provided dynamic enhancements based on detection of transients and other energy level variations.
5. Dolby Digital decoder
6. DTS-Interactive 5.1 Encoder Preferably, the module includes at least 3D audio virtualization technologies such as X-Fi CMSS®-3D Headphone and X-Fi CMSS®-3D Virtual. These virtual technologies are designed to reproduce a natural sounding multi-channel listening experience over headphones or two loudspeakers, with both multi-channel and two-channel source formats. By providing these technologies in a module that can be connected to a portable player such as an mp3 player or portable video player, these enhanced audio effects such as virtualization may be made available to consumers on the go.

In further detail, X-Fi Creative MultiSpeaker Surround 3D (CMSS-3D) is available for both rendering over headphones and speakers. Creative's CMSS®-3D Headphone technology helps the listener forget that he or she is wearing headphones, by delivering a compelling multi-channel listening experience, with any two-channel or multi-channel audio content. This is the result of the combination of three exclusive ingredients: HRTF filters, Environmental early reflections and Ambience extraction. The benefits of X-Fi CMSS®-3D Headphone include Timbre preservation; Improved externalization, frontalization and front-back discrimination. Further benefits include a natural sense of immersion, for both multi-channel and two-channel sources as well as reduced listening fatigue. Creative's CMSS®-3D Headphone technology employs advanced signal processing algorithms to place listeners in a natural, fully immersive sound field. Through these processing techniques operating with the assistance of at least one processor in the module, the auditory awareness of wearing headphones vanishes and is replaced by a transparent listening experience and the sensation of "being there".

Creative's CMSS®-3D Virtual technology provides a convincing multi-channel listening illusion using only two loudspeakers for a listener located at the "sweet spot", with any two-channel or multi-channel audio content. It combines the following ingredients: HRTF filters, Cross-talk canceller and Ambience extraction. The benefits of X-Fi CMSS®-3D Virtual include timbre preservation, convincing side and rear virtual loudspeaker localization, natural sense of immersion, with both multi-channel and two-channel sources. Preferably the module is configured to provide calibration according to the placement of the loudspeakers with respect to the listener. That is, the user can control the amount of the virtualization effect to optimize the effect to adjust for the loudspeaker positions.

Transient enhancement is provided in one embodiment by Creative's X-Fi Crystallizer. This is an intelligent, automated audio-restoration processor carefully designed to bring the full benefit of audio playback to 16-bit legacy audio content. Crystallizer selectively identifies significant transients in the original 16-bit audio playback stream and dynamically enhances these to compensate for the studio mastering compromises inherent in the limited dynamic range of CD audio. The end result of applying Crystallizer enhancement depends to some extent on the details of the content to which it is applied and to the user-specified degree of enhancement. In general, though, Crystallizer produces crisper high frequencies, punchier mid-range percussion (snare drums, congas) and note onsets, and stronger kick bass hits. This audio enhancement technique is thought to be especially beneficial to listeners of compressed music such as music encoded in the mp2, wma, or ATRAC formats. This configuration is believed to enhance MP3s and movies to the point of even sounding better to many listeners than content available from the original CD or DVD. It is a low-impact algorithm designed to improve the dynamic range of an audio stream by enhancing the natural transients. The transient enhancement provided by the Crystallizer algorithms can be very effective at sharpening an audio track (particularly compressed tracks, such as MP3 files), brightening sound effects, etc. Music benefits provided include low and high frequencies are enhanced while the dynamics are improved. Movie benefits include adding realism to explosions, gun-shots and high-impact audio sequences.

FIG. 1 is a diagram illustrating an audio enhancement module used in a system in accordance with one embodiment of the present invention. The system 100 includes speakers 102 an electrical connecting cord 106 to provide audio output signals, the audio enhancement module 104 and a portable media player 108. Preferably the media player 108 is a portable device configured to play at least digital audio files. More preferably, the media player 108 is configured to play also video files, thus enabling the enhancement of the audio portion of videos such as movies. In other embodiments the media player may be entirely an analog device such as a tape cassette player or receiver. The input connection providing the audio signals between the module 104 and the player 108 may be either analog or digital.

Figure 5A:
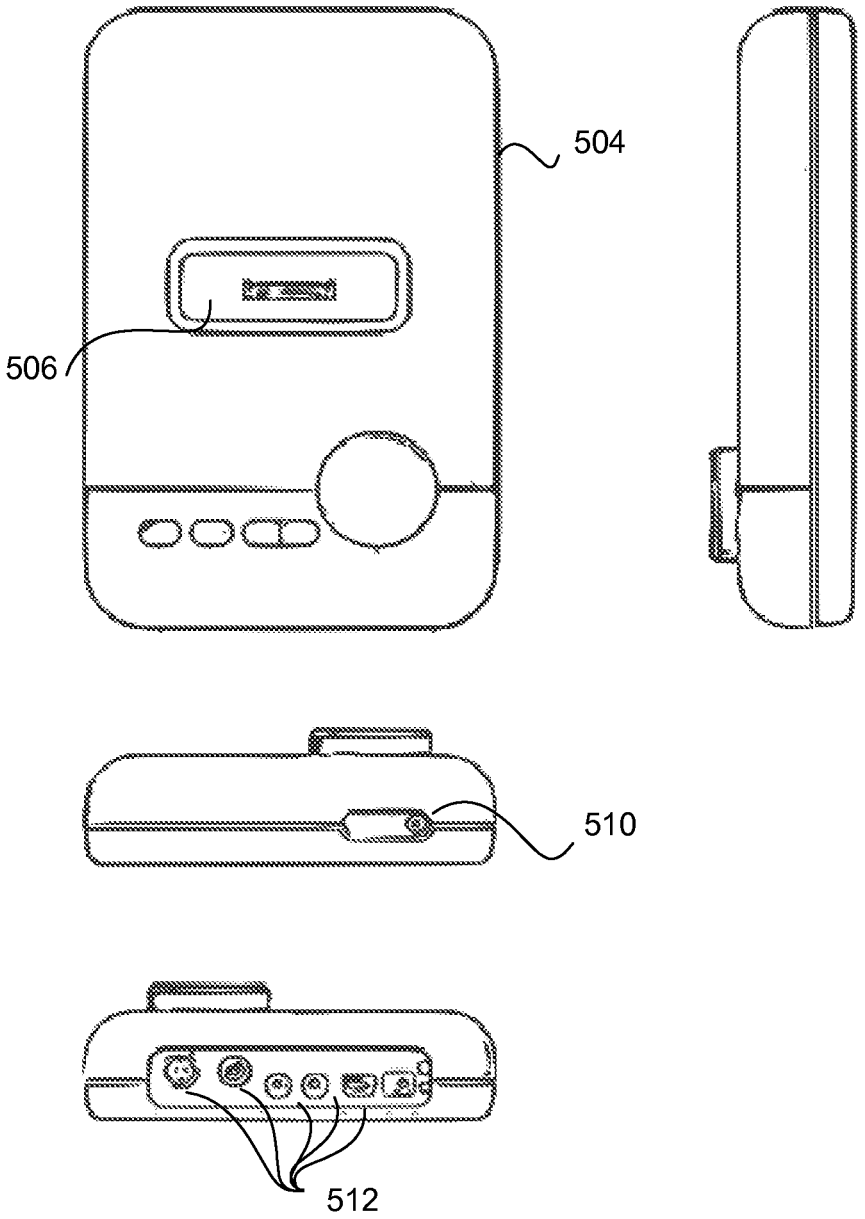
FIG. 5 is a diagram illustrating an audio enhancement module such as illustrated in FIG. 1 in accordance with one embodiment of the present invention.
Figure 5B:
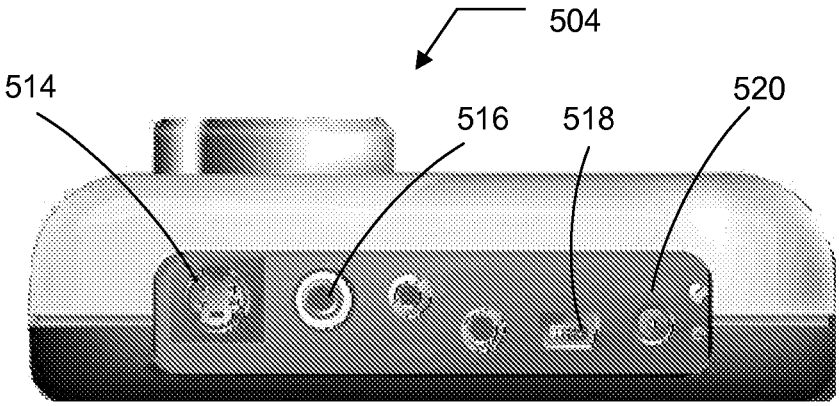
Figure 5B:
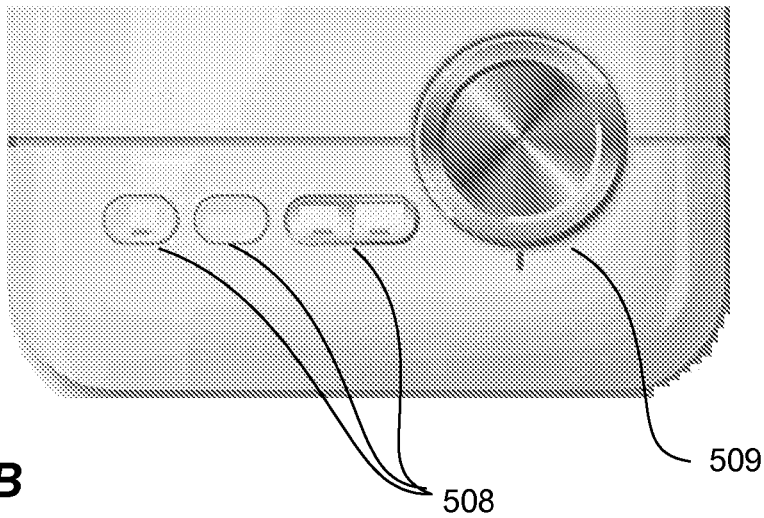

In this embodiment, the portable media player is preferably docked in the module 106. Further details as to the connections (ports) and a sample form factor are illustrated in FIG. 5. These illustrations and descriptions are intended to be illustrative and not limiting.

Figure 2:
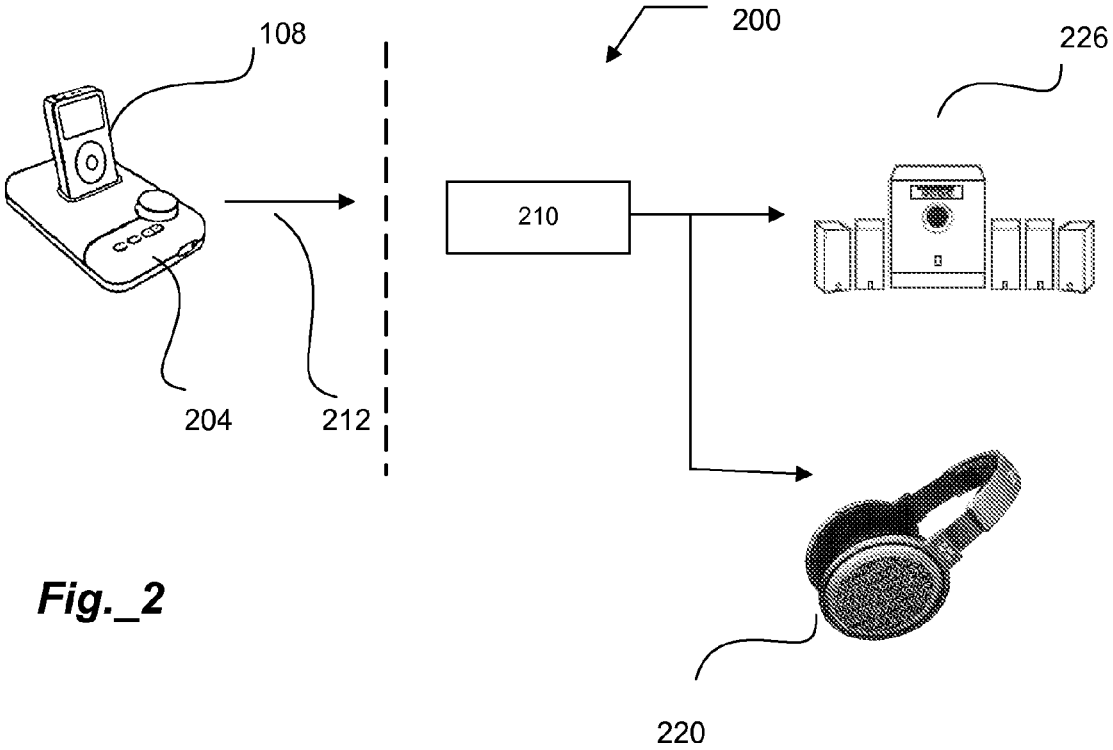
FIG. 2 is a diagram illustrating an audio enhancement module used in a system in accordance with one embodiment of the present invention.

FIG. 2 is a diagram illustrating an audio enhancement module used in a system in accordance with one embodiment of the present invention. The system 200 includes a portable media player 108, an audio enhancement module 204 that includes a wireless transmitter, a wireless receiver 210 and audio reproduction transducers such as speakers 226 or headphones 220. The audio enhancement module 204 is further preferably configured with at least audio enhancement modules that include CMSS-3D Headphone or Virtual. The wireless receiver 210 preferably provides an analog output to the transducers but the invention may also extend to digital transmission between these points. The Crystallizer audio transient enhancement option included in module 204 may be used to provide dynamic enhancement of the speakers or headphones. The system 200 may be configured, in one embodiment, to switch from a default CMSS-3D virtual mode to CMSS-headphone processing once the headphone is plugged in. This configuration may be used to provide a bridge between a portable player and a home theater system. This configuration may also be used, in another embodiment, to provide multipoint distribution, i.e., to provide music or another audio from the portable player to several rooms, each equipped with a receiver. In this way, a saving of wire can be achieved in a multi room music environment.

Figure 3:
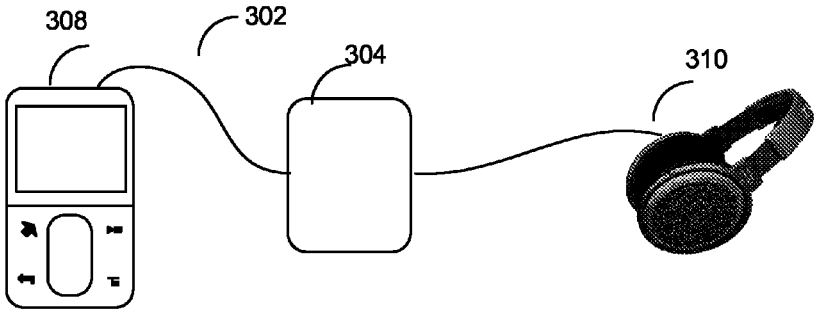
FIG. 3 is a diagram illustrating an audio enhancement module used in a system in accordance with one embodiment of the present invention.

FIG. 3 is a diagram illustrating an audio enhancement module used in a system in accordance with one embodiment of the present invention. In this embodiment the system includes a portable media player 308, an audio enhancement module 304, and headphones 310. The module 304 is preferably connected to the player 308 using an electrical cord. That is, the electrical cord is connected to the line out of the player 308. In other embodiments, the module 304 is connected to the player 308 to receive digital signals, for example through the use of a docking connector. Other connectors for conveying digital signals are known in the art to include firewire, USB, DDVI, and HDMI, and the present invention is intended to include all such connectors. The module 304 is preferably configured with audio enhancement processing techniques, including but not limited to all of the various techniques described or referred to in this specification in the various embodiments.

Figure 4:
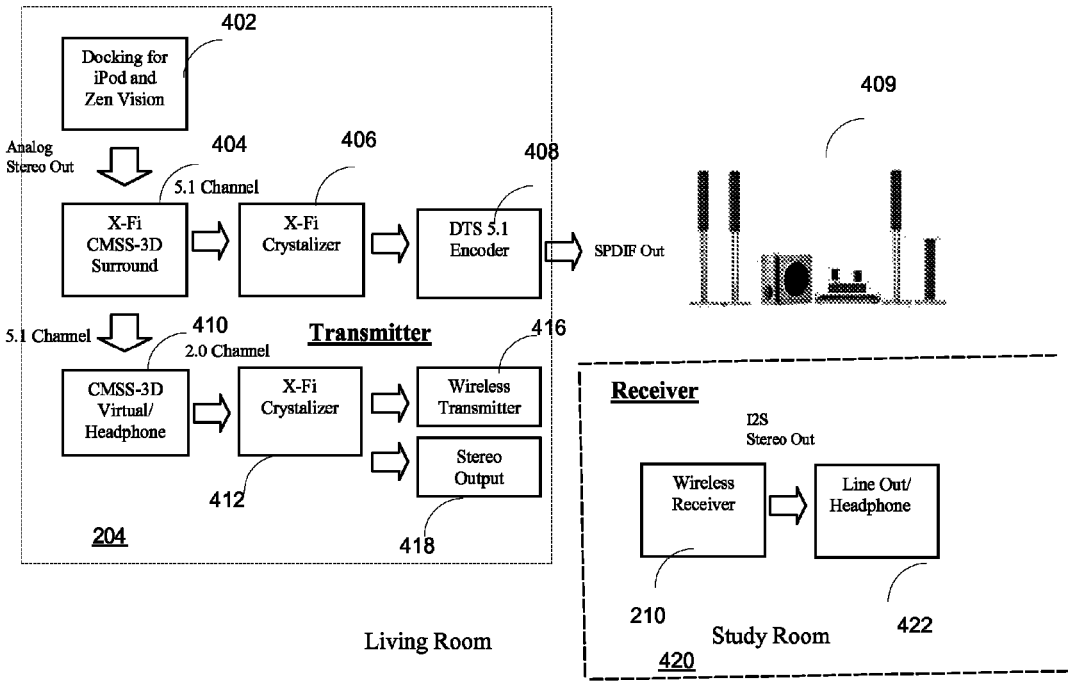
FIG. 4 is a diagram illustrating an audio enhancement system in accordance with one embodiment of the present invention.

FIG. 4 is a diagram illustrating an audio enhancement system in accordance with one embodiment of the present invention. The system provides an audio enhancement module 204 such as described generally with respect to FIG. 2.

The module includes a docking connector 402 for the player. In a preferred docking arrangement, power, control signals, and analog and digital data signals are provided through the connector contacts.

For example, where an analog signal is provided to the module, the module may be configured to enhance the audio with CMSS-3D surround (404). That is, a 5.1 audio signal may be generated, for example, form a two channel input signal, transients enhanced in Crystallizer portion 406 and encoded in the DTS 5.1 format in encoder 408. The signal may then be transmitted in this embodiment in digital form through the use of suitable cables to a 5.1 system 409.

Alternatively, for example for headphone use, the signal may be converted to a virtual surround signal in virtual headphone processing portion 410, enhanced in crystallizer (transient enhancement) portion 412 and forwarded to a wireless transmitter 416 or alternatively a stereo line output 418. When the transmitter is placed into effect, the study room 420 may be equipped with a wireless receiver 210 that provides a line out connection or a headphone connection. Of course at his point, the line out connection may be connected to an amplifier for amplification through a conventional stereo system as one alternative. Though the input (from the mp3 player) is shown as analog, this is for illustrative purposes only. Input to the module 204 may be digital. It should be noted that in preferred embodiments the analog input signals are converted to digital for digital signal processing in the module. That is, the audio enhancement techniques described are preferably implemented through digital signal processing techniques.

FIG. 5 is a diagram illustrating an audio enhancement module such as the module 104 illustrated in FIG. 1 (or module 204) in accordance with one embodiment of the present invention. The module 504 includes a connector 506, control buttons 508, a headphone jack 510, and input or output connectors 512. Preferably the connectors include s-video connector 514 and composite video connector 516. Further connectors include a USB or firewire connector 518 for connection to a host computer for configuration, loading content from a host computer to an attached mp3 player, and firmware updates. Alternatively, the enhancement module may be controlled with control buttons 508, such as may be configured to initiate the Crystallizer transient enhancement or 3D virtualization processes. Preferably, user input for controlling the amount of the various described audio enhancements available in the module is provided through user control 509. That is, the amount of the audio enhancement effects may be varied by the user in an interactive manner by manipulating this control 509.

Figure 6:
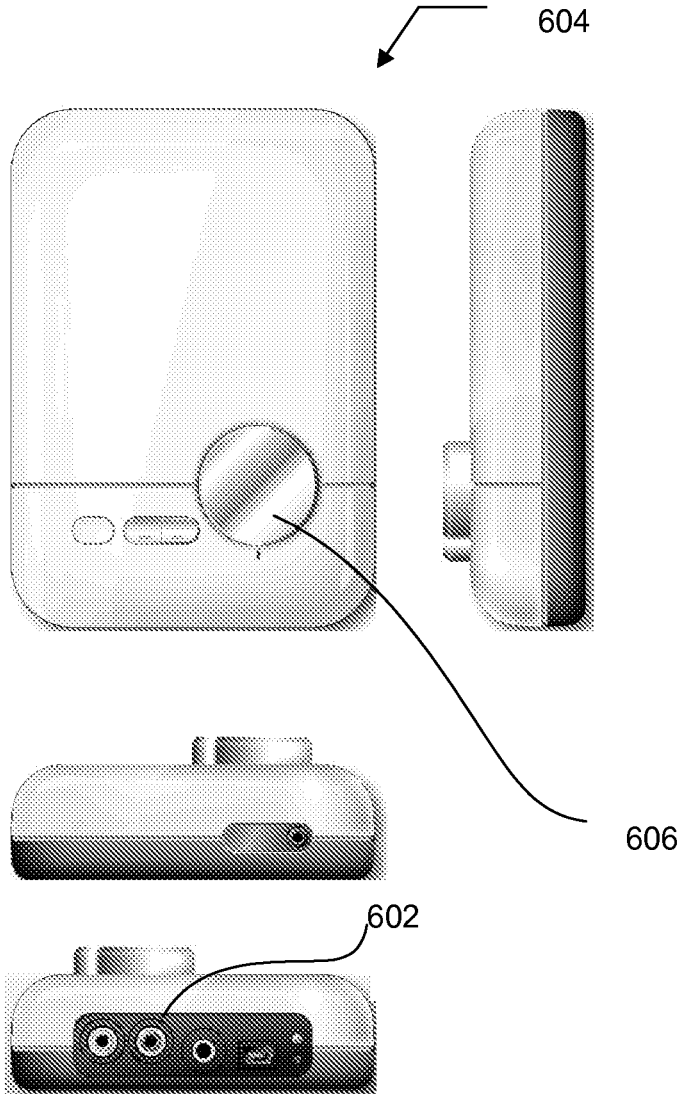
FIG. 6 is a diagram illustrating an audio enhancement module such as illustrated in FIG. 3 in accordance with one embodiment of the present invention.

FIG. 6 is a diagram illustrating an audio enhancement module such as illustrated in FIG. 3 in accordance with one embodiment of the present invention. The module 604 is preferably configure to include a wireless transmitter for transmission of the enhanced audio (or video) to other parts of the entertainment system. Rather than providing a docking connector, the device 604 includes an analog input terminal 602. The user is enabled to control the amount of transient enhancement and virtualization through the use of rotary control 606. Preferably, this control's functions can be switched to respectively control the volume.

Figure 7:
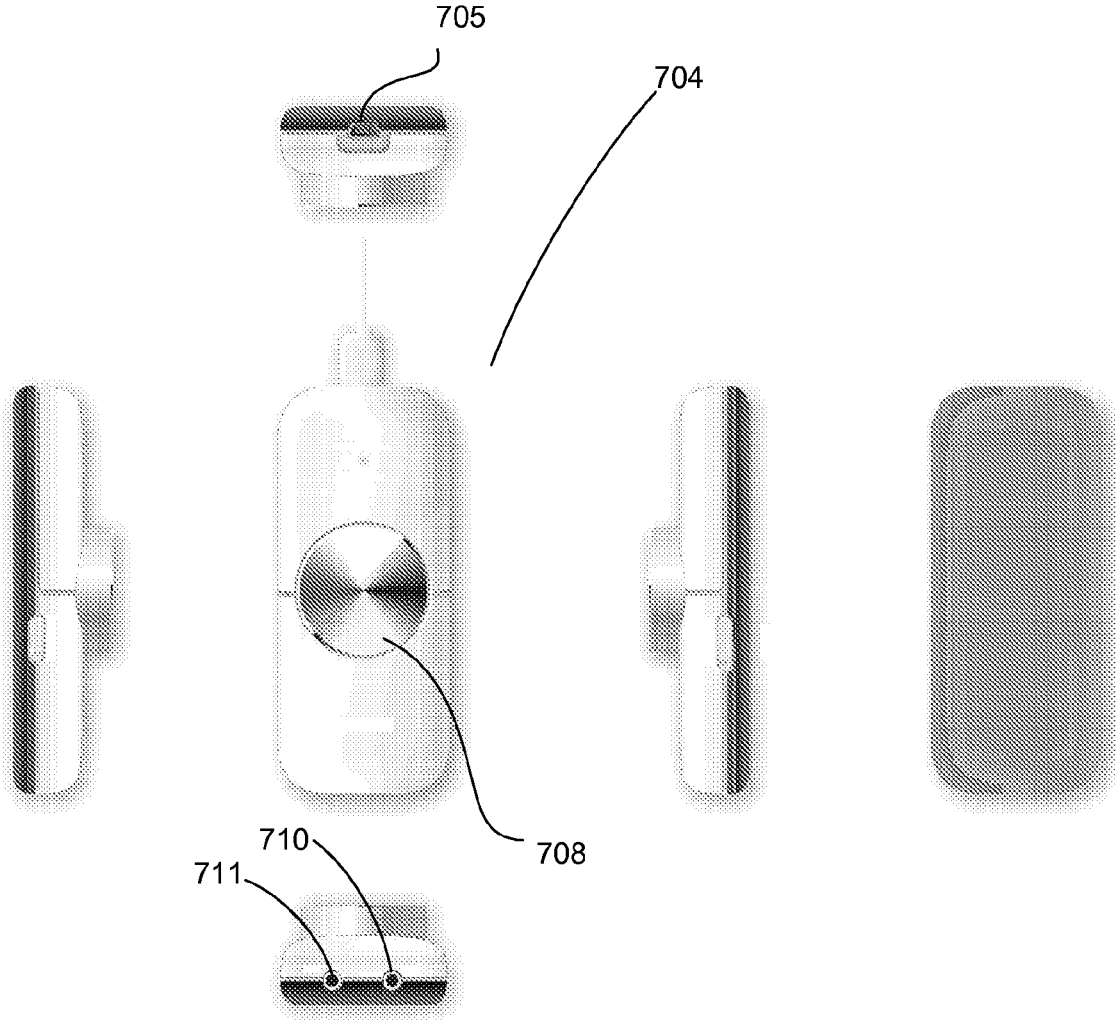
FIG. 7 is a diagram illustrating an audio enhancement module such as illustrated in FIG. 3 in accordance with one embodiment of the present invention.

FIG. 7 is a diagram illustrating an audio enhancement module such as illustrated in FIG. 3 in accordance with one embodiment of the present invention. The various views of the module 704 include a mini USB (or IEE1394) connector 705 and line in 711 and line out/headphone 710 connectors. A control 708 for controlling the amount of the audio enhancement is provided.

Figure 8:
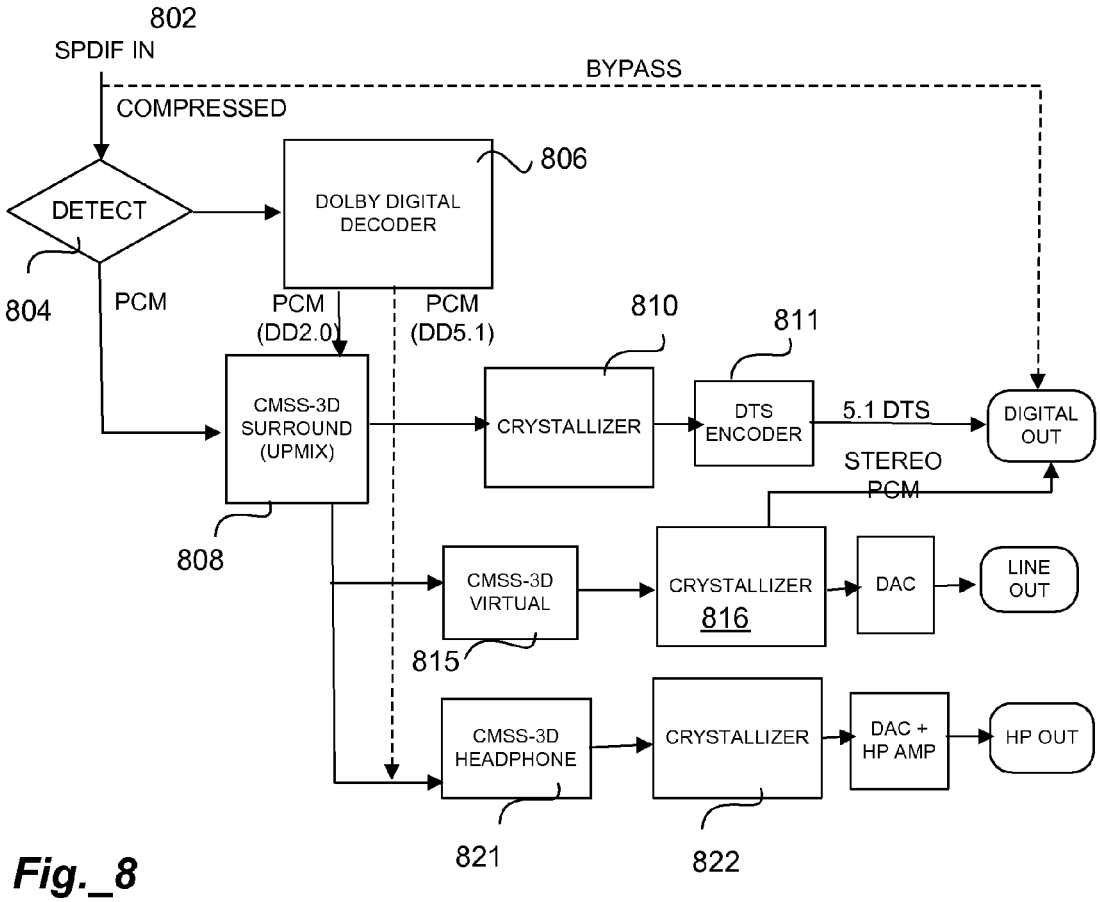
FIG. 8 is a block diagram of an audio enhancement module having a digital input in accordance with one embodiment of the present invention.

FIG. 8 is a block diagram of an audio enhancement module having a digital input in accordance with one embodiment of the present invention. Encoded signals are detected in block 804 and decoded in block 806. Signals in need of upmix are upmixed in block 808, for example to a 5 channel multichannel signal. Multichannel signals such as Dolby Digital 5.1 bypass the upmix stage. The multichannel signals are then processed in accordance with the output configuration desired. For example, where the signals are to be provided to a multichannel stereo system capable of decoding an encoded multichannel signal, the processing may optionally include transient detection-enhancement and subsequent encoding 811. For audio signals to be provided to speakers, such as a two speaker system, the signal is fed first to a virtualization block 815 and then (optionally) to a Crystallizer (transient detection-enhancement) block 816 before being output as either analog or digital forms of enhanced audio. This enhancement permits the listener to perceive that the sound is coming from multiple speaker locations even though provided over only two channels. The virtual surround process is preferably calibrated for optimum effect with a non-standard loudspeaker placement, for example through the use of a user control on the portable enhancement module.

Block 815 will preferably include cross-talk cancellation modules to preserve the virtualization effect. Crosstalk cancellation techniques are known to those of skill in the art and hence full details will not be provided herein. In similar fashion, the upmixed signal may be fed to headphone virtualization block 821 implementing technology such as Creative's CMSS-3D headphone technology for delivering a multichannel listening experience over two headphone channels. Crosstalk cancellation modules are not required in this path. Optionally, the signal is then fed to a Crystallizer (transient detection-enhancement) block 822 before output as an analog signal for delivery to a set of headphones.

In one embodiment, each of the virtualization modules (i.e., for headphones and speakers) include ambience extraction. With two-channel sources, the virtual surround loudspeakers are used to reproduce a natural enveloping ambience based on the ambient information already present in the recording. In another embodiment, a sound expansion processing technique is included in the module. For example, Creative's StereoXpand ambience extraction algorithm (also employed in CMSS-3DSurround and CMSS-3DHeadphone) may be integrated into the module. In one embodiment, in the virtualization blocks (e.g., blocks 815, 821) a 3D surround algorithm identifies ambient sound components in the original recording (such as room reverberation or applause) to derive the surround signals and perform center-channel extraction. This provides many benefits including enhancing the natural sense of immersion and depth without introducing overwhelming or unnatural ambience; enlarging the "sweet spot" in the listening room (by anchoring center-panned sounds in the front center channel and limiting the leakage of localized sounds in the surround channels) and preserving the original frontal stereo image in balance, width and timbre. It does not introduce instability in the frontal stereo image or in the surrounding ambiance. It does not introduce distortions in the surround channels, even with perceptually encoded sources such as MP3 or WMA.

Upmixing and the subsequent virtualization may be used to provide the perception of multiple speaker locations, for example including 5.1, 6.1, or 7.1 playback systems. The virtualization, such as provided by blocks 815 and 821 uses Head Related Transfer Function (HRTF) fitters to provide immersive 3D audio rendering, timbre preservation, improved externalization, frontalization and front-back discrimination.

Figure 9:
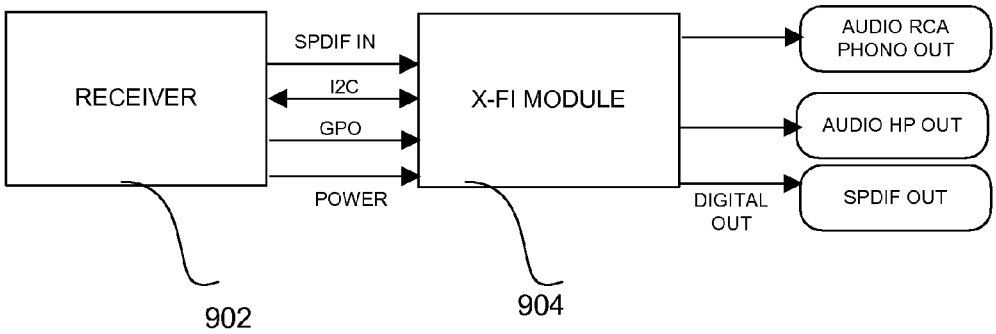
FIG. 9 is an application diagram of an audio enhancement module integrated into a receiver or other audio source in accordance with one embodiment of the present invention.

FIG. 9 is an application diagram of an audio enhancement module integrated into a receiver or other audio source in accordance with one embodiment of the present invention. The receiver 902, may be a set top box video/audio circuit board, for example in providing entertainment from cable or other video source and integrated therein may be an audio enhancement module 904 configured to provide the audio enhancement processing techniques described in this specification. The module 904 may be integrated as one or more chips on the mother board or back plane of the STB (set top box) or other receiver or alternatively included on a separate PCB within the "box: comprising the physical shell of the STB. Alternatively still, the module 904 may be connected by suitable cables or dongles to the receiver 902.

Portable player have become quite prevalent. Users with MP3 players listen to MP3 music, podcasting, voice recording, and news. Video and photo are included in the latest trend in portable player, for example enabling a user to play MPEG4 or DIVX video. These trends are enhanced through the current invention embodiments by allowing an in home and preferably portable audio interface with advance audio enhancements such as virtualization (X-Fi CMSS-3D Virtual or Headphone) and transient enhancement (Crystallizer) effects.

In addition, the modules of the various embodiments are preferably configured to up-mix stereo audio to multi-channel DTS Interactive format or other suitable formats. These can then be played in a home AV Receiver using a digital interface.

In accordance with another embodiment, wireless music is provided from the source portable media player. In one embodiment, convenience is provided by Portable player docking. The docking can be used to transmit control and data signals to and from the module and to provide automatic charging for players such as an iPod and Zen Vision.

The module can be configured in another embodiment to support "multi-cast" wireless receivers with line out or headphone out. Hence, a single audio enhancement module may be configured to supply a plurality of rooms or locations, each with its own set of loudspeakers or headphones.

The USB port is available to communicate with the PC for downloading content to the portable media player or simultaneously for charging. Preferably the separate module, such as enclosed in a suitable enclosure, is powered by DC adapter and able to charge the portable media player (e.g., mp3 player) battery in normal mode.

The transient enhancements in various embodiments include preferably enhancing musical dynamics by emphasizing sharp percussive sounds and transients, thereby creating a punchier and more dynamic listening experience.

By using the modules described in various embodiments of the present invention an enhance user listening experience is provided. Many different types of music audio signals may be processed and transmitted to rendering speakers, systems, or headphones. For example, enhanced audio provided at the output of the module may range from two channel analog to a high quality multi-channel digital signal. Further, transient may be detected and enhanced, the amount of the transient enhancement processing at the control of the user during playback.

An example and non-limiting specifications of one embodiment of the module include ADC resolution in Stereo: 16-bit, 44.1 kHz. DAC resolution, for example at the wireless receiver in one embodiment in Stereo: 16-bit, 44.1 kHz. Table 1 below identifies non-limiting examples of controls provided on the module in one embodiment. The rotary control in one embodiment is used to provide to the user level adjustment of Volume, virtualization, and transient enhancement.

TABLE 1

| Control and Indicator | Location | Remark |
|---|---|---|
| Select Button | Top | Press for 2 sec to standby. Click to toggle between CMSS3D→ Crystalizer→ volume control |
| Rotary control | Blue ring | Blue LED ring and blinking during level adjustment of Volume, X-Fi CMSS-3D, X-Fi Crystalizer |
| X-Fi CMSS-3D | Top | X-Fi CMSS-3D Enable |
| X-Fi Crystalizer | Top | X-Fi Crystalizer Enable |
| 5.1 DTS | Top | DTS Interactive Encoder |
| Volume LED | Top | Blue in default mode as volume. Blue ring and volume LED will blink when rotary knob is turned. Press rotary knob to mute and volume LED will turn Red |
| X-Fi CMSS-3D LED | Top | Blue LED to indicate enable status and blinking to indicate amount control. |
| X-Fi Crystalizer LED | Top | Blue LED to indicate enable status and blinking to indicate amount control. |
| DTS 5.1/Stereo display | Top | Blue LED |
| IR Receiver | Front | |
| Wireless Connect Button | Back | |

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A portable module suitable for use with an electronic device which is configurable to communicate an audio signal, the portable module being configurable to provide audio enhancement effects to the audio signal, the audio enhancement effects provided being unavailable in the electronic device, the portable module comprising:

an input terminal for receiving the audio signal;

a processor configured to perform audio enhancement technique of detecting transients in the audio signal and enhancing the magnitudes of the transients, thereby facilitating audio enhancement effects to the audio signal in a manner so as to embed enhanced audio effects to the audio signal; and an output terminal for transmitting an output audio signal corresponding to the audio signal communicated from the electronic device having enhanced effects embedded therein.

2. The portable module as recited in claim 1 wherein the output terminal is further configured to transmit a wireless rendered signal to a plurality of wireless receivers.

3. The portable module as recited in claim 1 wherein the electronic device corresponds to a portable media player.

4. The portable module as recited in claim 3 wherein the input terminal is a docking connector configured for receiving the portable media player.

5. The portable module as recited in claim 4 wherein the docking connector is further configured to provide power and to load content to the portable media player.

6. The portable module as recited in claim 1 wherein the module is configured for receiving both an audio and a digital input signal.

7. The portable module as recited in claim 1 wherein the module is configurable to enable a user to select from several surround audio enhancement effects and to control the amount of the effect in accordance with user preference.

8. The portable module as recited in claim 7 further comprising a user control usable to control the amount of audio enhancement effects.

9. The portable module as recited in claim 8 wherein the user control corresponds to a rotary control.

10. The portable module as recited in claim 1 wherein the processor is further configured:

to perform another audio enhancement technique of processing the audio signal so that a listener is capable of audibly perceiving that sound is coming from multiple speaker locations although it is provided by two channels.

11. The portable module as recited in claim 1, wherein the output audio signal is communicable from the output terminal to a speaker system, and wherein the module is configurable to remix the audio signal to match the speaker system.

* * * * *